US007762325B2

(12) United States Patent
Ellson et al.

(10) Patent No.: US 7,762,325 B2
(45) Date of Patent: Jul. 27, 2010

(54) METHODS AND APPARATUS TO APPLY AXIAL FORCE TO A PACKER IN A DOWNHOLE TOOL

(75) Inventors: Nicholas Ellson, Houston, TX (US); Yves Barriol, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 327 days.

(21) Appl. No.: 11/828,036

(22) Filed: Jul. 25, 2007

(65) Prior Publication Data

US 2009/0025983 A1 Jan. 29, 2009

(51) Int. Cl.
*E21B 33/12* (2006.01)

(52) U.S. Cl. ..... 166/187; 166/106; 166/122; 166/377

(58) Field of Classification Search ..... 166/106, 166/122, 187, 377, 108
See application file for complete search history.

(56) References Cited

U.S. PATENT DOCUMENTS 2,828,823 A * 4/1958 Mounce ..... 277/331
3,575,238 A * 4/1971 Shillander ..... 166/187
3,690,375 A * 9/1972 Shillander et al. ..... 166/187
4,299,397 A * 11/1981 Baker et al. ..... 277/333
4,403,660 A * 9/1983 Coone ..... 166/387
5,277,253 A * 1/1994 Giroux et al. ..... 166/187
5,297,633 A * 3/1994 Snider et al. ..... 166/387
2006/0090905 A1 5/2006 Brennan, III et al.

* cited by examiner

*Primary Examiner*—William P Neuder
*Assistant Examiner*—Nicole A Coy
(74) *Attorney, Agent, or Firm*—Dave R. Hofman

(57) ABSTRACT

Methods and apparatus to apply axial force to a packer in a downhole tool are described. In one described example, an apparatus to apply an axial force to an inflatable packer associated with a downhole tool includes a sleeve slidingly coupled to a body of the downhole tool and an end of the packer. An inner portion of the sleeve is sealed against the body of the downhole tool to form a chamber, and the chamber is fluidly coupled to a pump associated with the downhole tool to receive a pressurized fluid to cause the sleeve to apply an axial force to the packer.

18 Claims, 4 Drawing Sheets

METHODS AND APPARATUS TO APPLY AXIAL FORCE TO A PACKER IN A DOWNHOLE TOOL

FIELD OF THE DISCLOSURE

The present disclosure relates generally to downhole tools and, more particularly, to methods and apparatus to apply axial force to a packer in a downhole tool.

BACKGROUND downhole tools for sampling fluid from subterranean formations, measuring formation fluid pressures, conducting formation tests, etc. often include one or more inflatable packer assemblies or packers (e.g., straddle packers) to hydraulically isolate or seal a section of a wellbore or borehole that penetrates a formation to be tested or sampled. Such inflatable packer assemblies typically include a flexible packer element made from an elastomeric material that is reinforced with metal slats or cables. However, due to the harsh conditions (e.g., high temperatures) within many boreholes, the elasticity and mechanical strength of the elastomeric material of the packer element can become significantly compromised. Thus, a packer may be inflated to seal against a portion of the borehole and may retain a relatively large outside diameter after the inflation pressure has been released. In some cases, the outside diameter of the previously inflated packer may be large enough to prevent the downhole tool to which it is attached from being removed from the borehole, thereby resulting in a costly well repair and/or tool recovery operation.

Additionally, in applications where an inflatable packer is used with a downhole tool deployed via a drill string, a packer element may inadvertently expand as a result of the rotation and become wedged in the borehole. This may cause the packer to become damaged or may even result in the tool becoming stuck in the borehole.

SUMMARY

In one example, an apparatus to apply an axial force to an inflatable packer associated with a downhole tool includes a sleeve slidingly coupled to a body of the downhole tool and an end of the packer. An inner portion of the sleeve is sealed against the body of the downhole tool to form a chamber, and the chamber is fluidly coupled to a pump associated with the downhole tool to receive a pressurized fluid to cause the sleeve to apply an axial force to the packer.

In another example, a downhole tool includes a pump module, an inflatable packer fluidly coupled to the pump module, a sliding member coupled to the inflatable packer, a chamber formed between the sliding member and a body of the downhole tool, and a fluid passage to fluidly couple the chamber to the pump module to cause the sliding member to apply an axial force to the inflatable packer.

In another example, a method of retracting a packer associated with a downhole tool involves deflating the packer and pumping a fluid into a chamber formed between a sliding sleeve coupled to an end of the packer and a body of the downhole tool to retract the packer.

In yet still another example, a method of changing an axial force applied an inflatable packer involves obtaining a fluid from a borehole in which the inflatable packer is located and pumping the fluid into or out of a chamber formed between a sliding sleeve coupled to an end of the packer and a body of the downhole tool to change an axial force applied to the packer.

In still another example, a method of obtaining a downhole pressure measurement includes, lowering a downhole tool in a wellbore, inflating at least one packer disposed on the tool, measuring a pressure in an area of the borehole that is at least partially defined by the packer, measuring a parameter associated with the movement of the sleeve with a sensor, and associating the measured parameter with the measured pressure.

DETAILED DESCRIPTION

Figure 1:
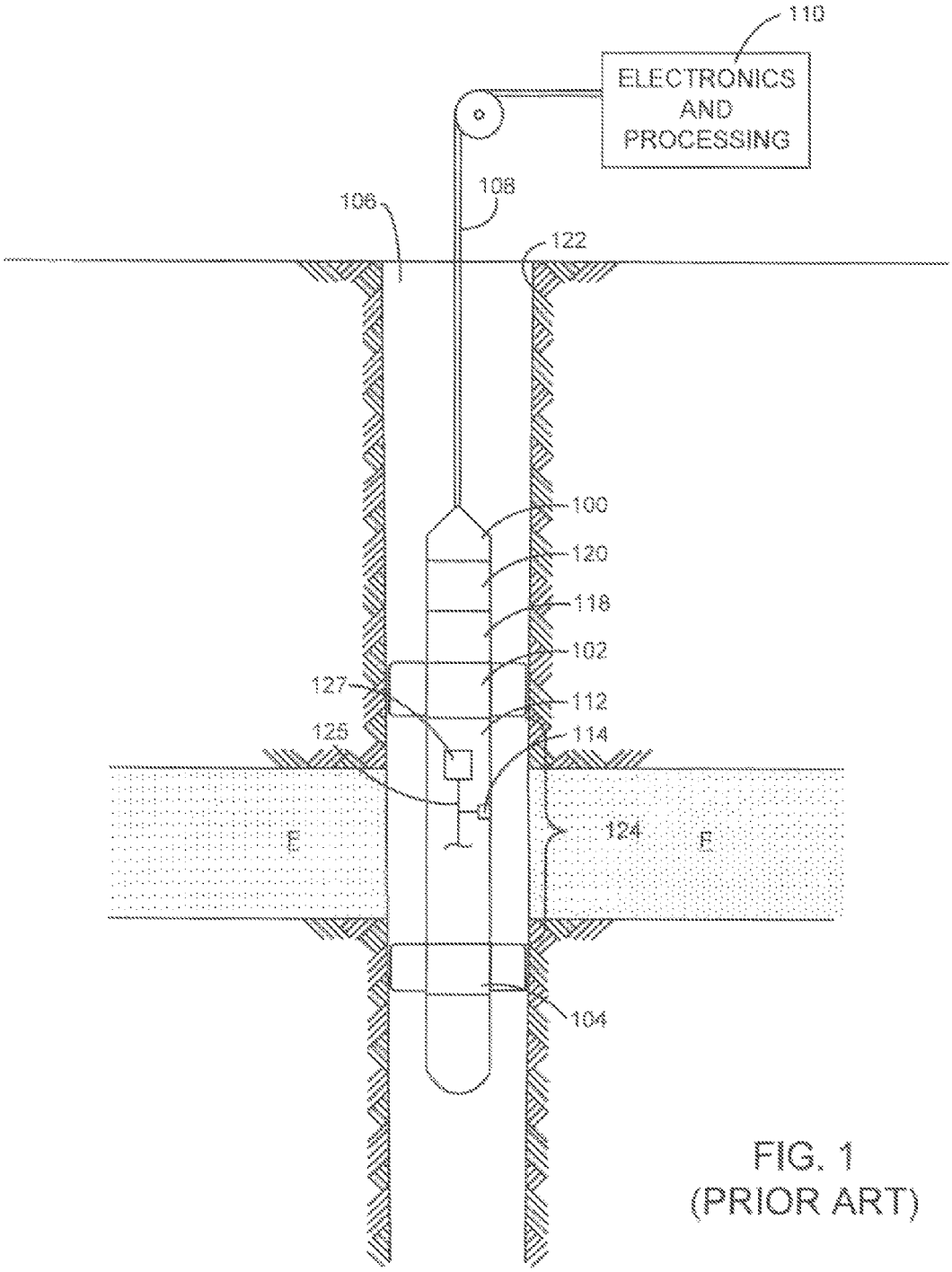
FIG. 1 (PRIOR ART)
FIG. 1 depicts an example of a downhole tool employing known inflatable packer assemblies.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

In general, the example methods and apparatus described herein may be used to apply axial force to an inflatable packer element. The example methods and apparatus may, for example, be used to retract a previously inflated packer associated with a downhole tool. More specifically, the example methods and apparatus described herein involve an inflatable packer assembly for use with a downhole tool where an end of the inflatable packer element (e.g., an elastomeric bladder or body) is coupled to a sliding member, sleeve, ring, or collar that applies axial force to the packer element to retract packer element (i.e., draw the packer element toward a body of the downhole tool) after the packer element has been inflated and then deflated. In this manner, a packer element that has been inflated under downhole conditions (e.g., a relatively high temperature) that substantially reduce the elasticity of the packer element can still be retracted to reduce its outer diameter sufficiently to enable a downhole tool to which the packer element is attached to be removed from a borehole.

In one described example, an inflatable packer assembly associated with a downhole tool includes a collar, ring, or sleeve slidingly coupled (e.g., via threads) to a body, mandrel, or any other tubular portion of the downhole tool and an end of the packer. The other end of the packer is fixed (i.e., does not move) relative to the body, mandrel, or other tubular portion of the downhole tool. An inner portion of the sleeve is sealed against the body of the downhole tool via two sliding seals (e.g., o-rings, t-seals) to form a chamber. The chamber is fluidly coupled to a pump such as, for example, a pump within a pumpout or pump module associated with the downhole tool to receive a pressurized fluid (e.g., borehole fluid) to apply an axial force that moves the sleeve to retract the packer toward the downhole tool.

Initially, in operation, the pump or pump module may be used to pump pressurized borehole fluid into the packer to inflate the packer and isolate or seal a section of a borehole (e.g., a section associated with a formation to be sampled or otherwise tested) in which the downhole tool is disposed. Following the sampling or other testing within the isolated section of the borehole, the pressurized borehole fluid within the packer is released to deflate or depressurize the packer. The pump or pump module is then used to pump pressurized borehole fluid into the chamber formed by the sliding, collar, ring, or sleeve. When the fluid pressure within the chamber exceeds the hydrostatic pressure in the borehole surrounding the downhole tool, the sleeve moves or slides relative to the body of the downhole tool away from the fixed end of the packer and, thus, applies an axial force to the packer that retracts the packer toward the body of the downhole tool and thereby reduces the outer diameter of the packer to facilitate removal of the downhole tool from the borehole.

Additionally or alternatively, the example apparatus and methods described herein may use the axial force applied to the end of the packer to apply tension to the packer to prevent inadvertent deployment or expansion of the packer element (e.g., when the inflatable packer is in a deflated condition) during, for example, rotation of a downhole tool associated with the packer.

FIG. 1 depicts an example of a downhole tool 100 employing known inflatable packer assemblies 102 and 104. The example downhole tool 100 is depicted as being deployed (e.g., lowered) into a wellbore or borehole 106 to sample a fluid from a subterranean formation F. The downhole tool 100 is depicted as a wireline type tool and, thus, is lowered into the borehole 106 via a cable 108, which bears the weight of the downhole tool 100 and which includes electrical wires or additional cables to convey power, control signals, information carrying signals, etc. between the tool 100 and an electronics and processing unit 110 on the surface adjacent the borehole 106. While the example downhole tool 100 is depicted as being deployed in the borehole 106 as a wireline device, the tool 100 could alternatively or additionally be deployed in a drill string, using coiled tubing, or by any other known method of deploying a tool into a borehole.

The downhole tool 100 includes a sampling module 112 having a sampling inlet 114. The sampling 112 module may further include an extendable probe (not shown) associated with the inlet 114 and an extendable anchoring member (not shown) to anchor the tool 100 and the probe in position to contact the formation F. The inlet 114, as shown, is a single inlet. However, a second or additional inlets (not shown) may operate in conjunction with the inlet 114 to facilitate dual inlet (i.e., guard) sampling.

To extract borehole fluid from the urea to be isolated by one or both of the packers 102 and 104, the tool 100 includes a pumping module 118. The pumping module 118 may include one or more pumps, hydraulic motors, electric motors, valves, flowlines, etc. to enable borehole fluid to be removed from a selected area of the borehole 106.

To convey power, communication signals, control signals, etc. between the surface (e.g., to/from the electronics and processing unit 110) and among the various sections or modules composing the downhole tool 100, the tool 100 includes an electronics module 120. The electronics module 120 may, for example, be used to control the operation of the pumping module 118 in conjunction with operation of the packers 102 and/or 104, to, for example, hydraulically isolate a portion of the borehole 106 to facilitate sampling or testing a portion of the formation F.

In operation, the downhole 100 may be lowered via the cable 108 into the borehole 106 to a depth that aligns the sampling module 112 and, particularly, the sampling inlet 114, with a portion of the formation F to be sampled. The pumping module 118 may then be used to pump pressurized borehole fluid into the packers 102 and 104 to inflate the packers 102 and 104 so that the outer circumferential surfaces of the packers 102 and 104 sealingly engage a wall 122 of the borehole 106. With the packers 102 and 104 inflated, an area or section 124 of the borehole 106 between the packers 102 and 104 is hydraulically isolated from the remainder of the borehole 106. The area 124 may be referred to as the interval, and the fluid contained therein would be at an interval pressure. The pumping module 118 is then used (e.g., controlled by the electronics module 120 and/or the electronics and processing unit 110) to pump borehole fluid out of the area or section 124 of the borehole 106. The pumping module 118 is then used to pump formation fluid from the formation F via the inlet 114 and a flowline 125 into a sample chamber 127 within the tool 100. The sample chamber 127 need not be located in the sampling module 112 as shown but may, for example, be located in its own sample module (not shown).

Following collection of a sample, the pressurized fluid within the packers 102 and 104 is released (e.g., by the pumping module 118) into the borehole 106 outside of the area 124. However, even if the packers 102 and 104 are deflated or the pressurized fluid within the packers 102 and 104 is released, the packers 102 and 104 may maintain a relatively large outer diameter (i.e., not fully contract to their pre-inflation diameters), particularly if the area 124 of the borehole 106 is at a relatively high temperature. If the outer diameter of one or both of the packers 102 and 104 is not reduced to less than the minimum diameter of the borehole 106, withdrawal of the tool 100 from the borehole 106 may be very difficult or impossible without significant damage to the tool 100 and/or the borehole 106.

Figure 2:
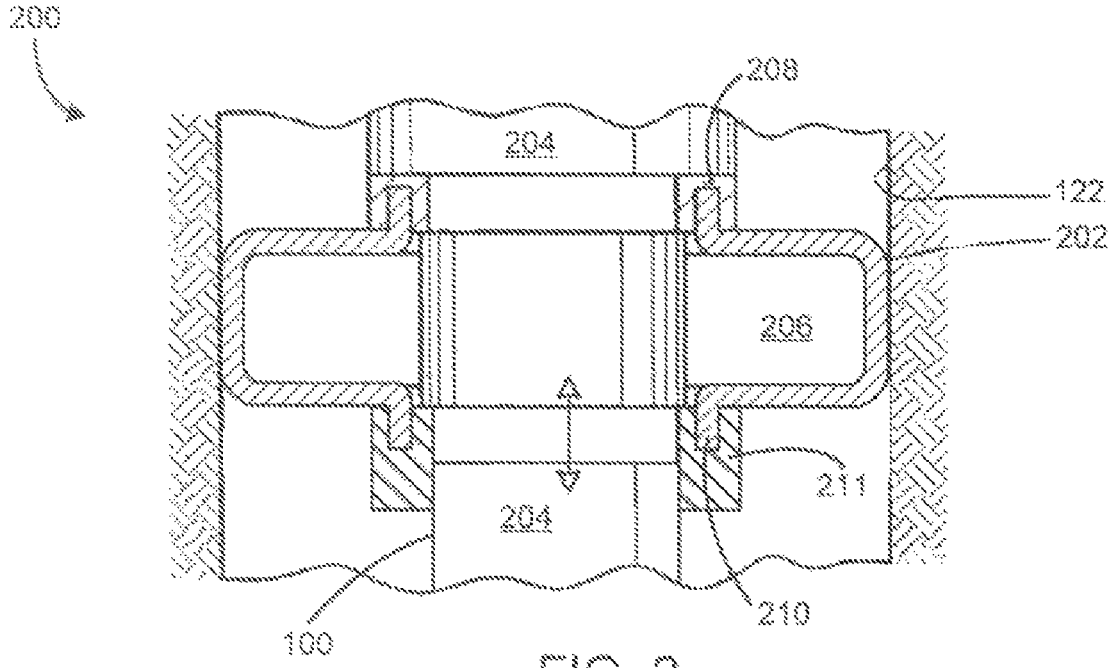
FIG. 2 (PRIOR ART)
FIG. 2 is a detailed cross-sectional view of one of the inflatable packer assemblies shown in FIG. 1.

FIG. 2 is a detailed cross-sectional view of a known inflatable packer assembly 200 that is used to implement the packer assemblies 102 and 104 shown in FIG. 1. The inflatable packer assembly 200 includes a flexible packer element 202 (e.g., an elastomeric material to form an inflatable bladder, tube, etc.) that is coupled to a tubular body or mandrel 204 of the tool 100 to define a cavity 206 that can be filled with pressurized borehole fluid to cause the packer element 202 to sealingly engage the borehole wall 122. As is known, the packer element 202 may include reinforcing cables or slats (not shown) to strengthen the packer element 202 and to facilitate the return of the packer element 202 to its original (i.e., pre-inflation) shape. As can be seen in FIG. 2, end 208 is coupled to the tool 100 and is fixed in place (e.g., does not move relative to the body of the tool 100). In contrast, end 210 is attached to a sliding member 211 that slidingly engages the tool 100. In this configuration, the sliding member 211 traverses toward the end 208 during inflation of the packer element 202.

Preferably, a lower end (as oriented in FIG. 1) of the packer elements slidingly engage the tool with the upper end being fixed. A sliding lower end ensures that when the tool 100 is pulled from the borehole, any friction between the packer elements and the borehole biases the packer toward a closed position, while a sliding upper end could potentially jam or bunch the packer elements between the tool and the borehole wall 122 as the tool 100 is pulled from the borehole.

Figure 3:
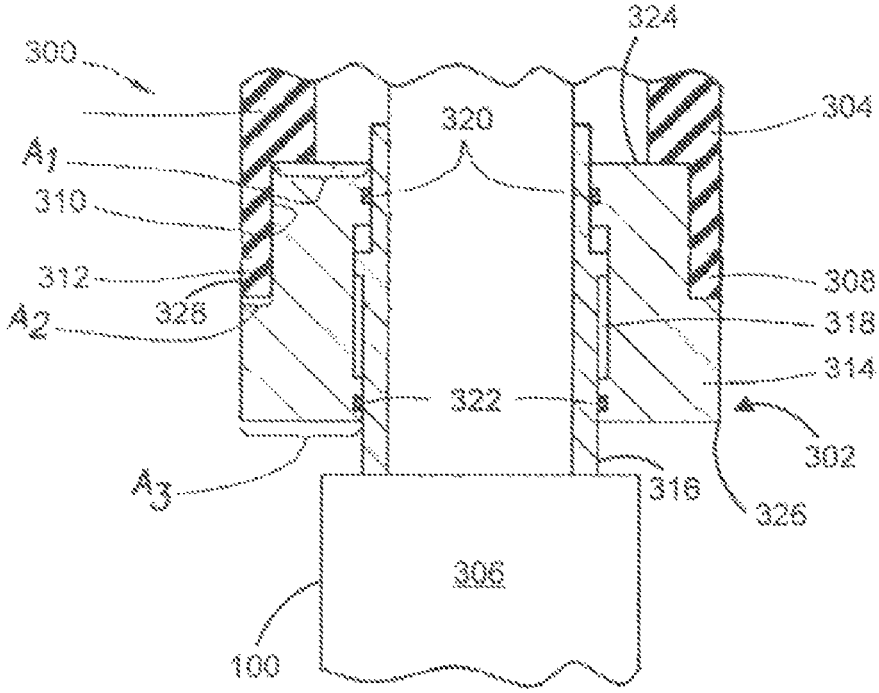
FIG. 3 (PRIOR ART)
FIG. 3 is a cross-sectional view of a portion of an alternative known inflatable packer assembly having a mechanism that applies an axial force to a packer element and that may be used instead of the inflatable packer assembly depicted in FIG. 2.

FIG. 3 is a cross-sectional view of a portion of an alternative known inflatable packer assembly 300 having a retraction mechanism 302 and that may be used instead of the inflatable packer assembly 200 depicted in FIG. 2. With the packer assembly 300, one end (not shown) of a packer element 304 is fixed to a tubular body or mandrel 306 of the downhole tool (e.g., similar to the tool 100 of FIG. 1) and another end 308 is coupled via threads 310 and 312 to a sliding member, collar, ring, or sleeve 314. The sliding member 314 is slidably and sealingly engaged with a sleeve 316 that engages the body 306 of the tool 100 and forms a low pressure chamber 318 (e.g., at atmospheric pressure) between the sliding member 314 and the sleeve 316. Seals (e.g., o-rings) 320 and 322 provide a sliding seal between the inner surface of the sliding member 314 and the outer surface of the sleeve 316. An end 324 of the sliding member 314 attached to the packer element 314 has as greater surface area (i.e., $A_1+A_2$) exposed to the borehole fluid pressure than a surface area (i.e., $A_3$) associated with an opposite end 326 of the sliding member 314. Thus, when both of the ends 324 and 326 of the sliding member 314 are exposed to the hydrostatic pressure of the borehole fluid (e.g., when the packer element 304 is deflated), a net force urging the sliding member 314 toward the smaller surface 326 (i.e., away from an end 328 of the packer element 304) of the sliding member 314 causes the sliding member 314 to apply an axial force to the packer element 304. The application of such an axial force to the packer element 304 draws the packer element 304 toward the body 306 of the tool and reduces the outer diameter of the packer element 304. A more detailed description of the known packer assembly 300 can be found in U.S. Patent Publication No. 2006/0090905, the contents of which is hereby incorporated by reference in its entirety.

Figure 4:
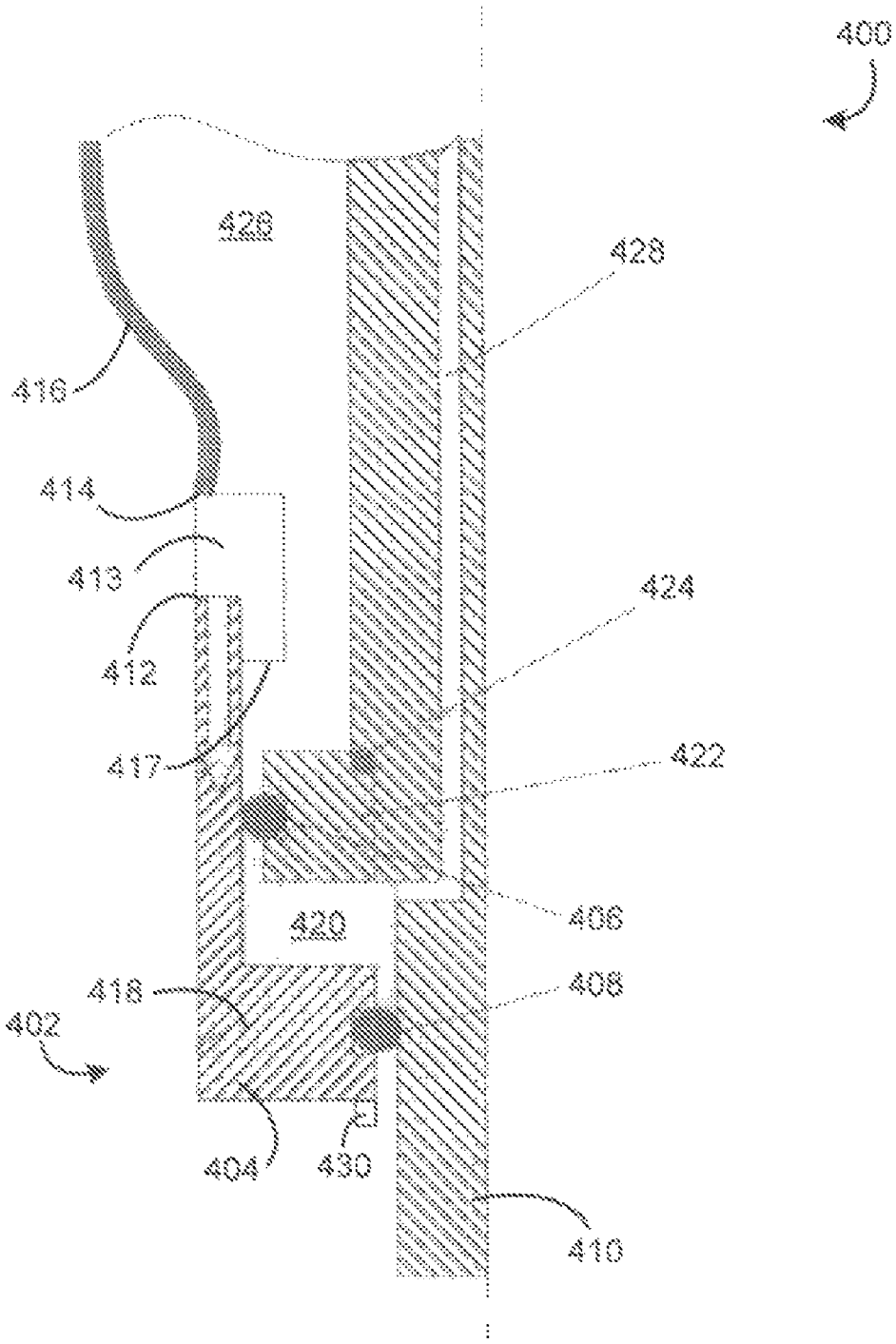
FIG. 4 is a cross-sectional view of a portion of an example inflatable packer assembly having a mechanism that applies an axial force to a packer element and that may be used instead of the inflatable packer assembly depicted in FIG. 2.

FIG. 4 is a cross-sectional view of a portion of an example inflatable packer assembly 400 having a mechanism 402 to apply axial force to a packer element and that may be used instead of the known inflatable packer assembly 300 depicted in FIG. 3. For purposes of clarity and simplicity, FIG. 4 depicts only a portion of the example inflatable packer assembly 400. However, in view of the structures shown in FIG. 4, those having ordinary skill in the art will readily understand how to implement those structures in connection with inflatable packer assemblies for use with downhole tools.

Turning in detail to FIG. 4, a sliding member, collar, ring, or sleeve 404 is slidably and sealingly engaged via sliding seals 406 and 408 to a mandrel or tubular body 410 of a downhole tool (e.g., similar to the tool 100 of FIG. 1). An end 412 of the sliding member 404 is coupled via a coupling element 413 to an end 414 of an inflatable packer or packer element 416 so that when the sliding member 404 is urged, forced, and/or moved away (e.g., downward in FIG. 4) from the packer element 416, axial force is applied to the packer element 416 to retract or reduce the outer diameter of the packer element 416 in its deflated state or condition. The coupling element 413 may be threadingly or otherwise engaged or attached to the end 412 of the sleeve 404. Additionally, the coupling element 413 provides a stop surface 417 to limit the range of travel of the sleeve 404.

As shown in FIG. 4, the sliding member 404 has a generally L-shaped cross-section or profile including a lip portion 418 that at least partially defines a chamber 420. In the example of FIG. 4, a ring 422 is coupled (e.g., threaded onto) the tubular body or mandrel 410 to further define the chamber 420. An additional seal (e.g., an o-ring) 424 may be provided to eliminate a potential leakage path between the chamber 420 and a cavity 426 defined by the packer element 416. As described in more detail in connection with FIG. 5 below, the chamber 420 is fluidly coupled to a source of pressurized borehole fluid via a line 428 to enable the chamber 420 to be pressurized with borehole fluid at a pressure that exceeds the hydrostatic pressure (e.g., in a borehole) surrounding the tool to cause the sliding member 404 to apply axial force to the packer element 416 to, for example, retract (e.g., reduce the outside diameter of) the packer element 416 when the packer element 416 is deflated. Additionally, fluid may be pumped out of the chamber 420 via the line 428 to reduce the pressure in the chamber 420 to be less than the hydrostatic pressure surrounding the tool.

Figure 5:
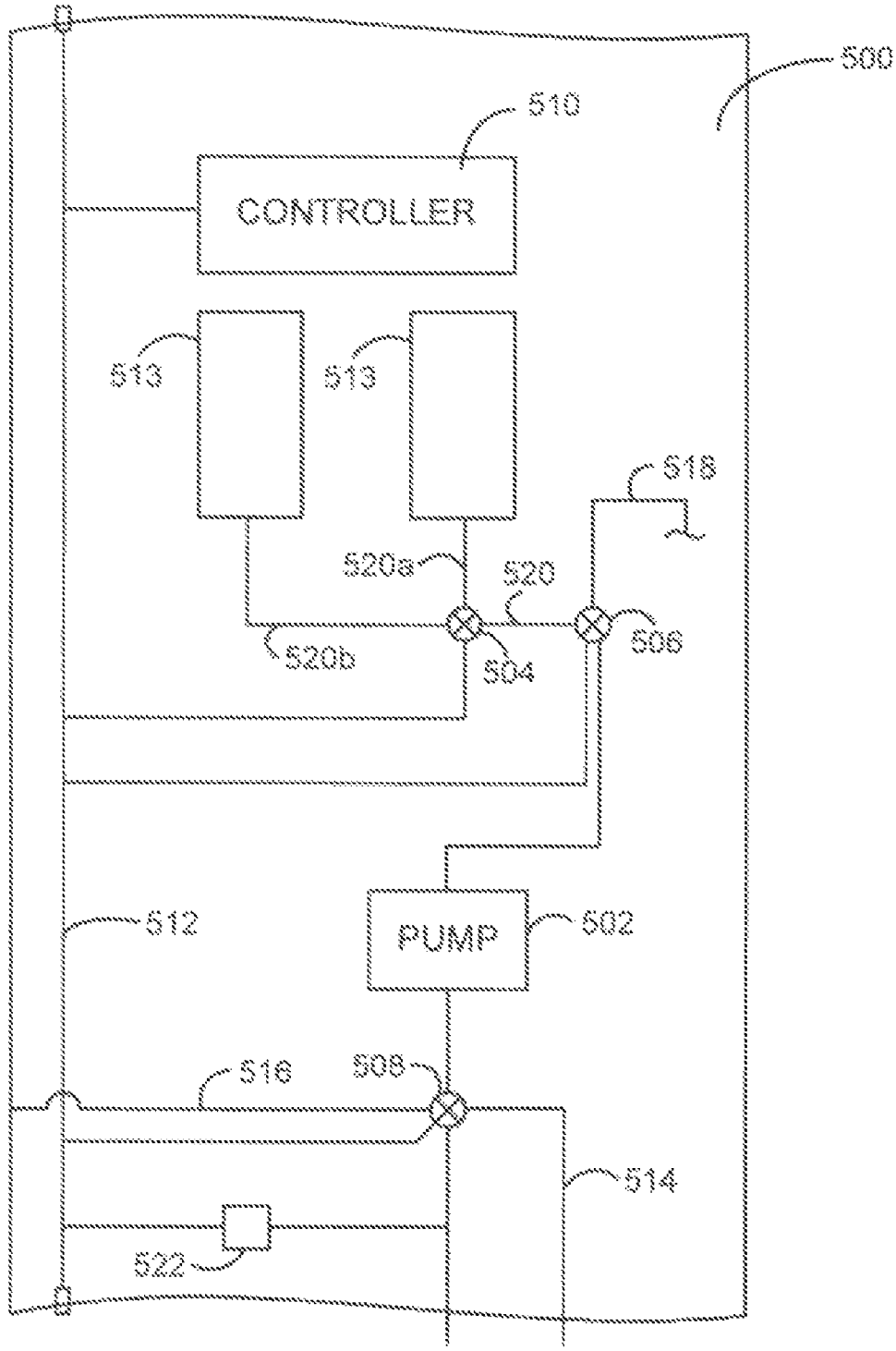
FIG. 5 is a block diagram of an example pump module that may be used with the example inflatable packer of FIG. 4.

FIG. 5 is a block diagram of an example pump module 500 that may be used with the example inflatable packer assembly 400 of FIG. 4. As depicted in FIG. 5, the pump module 500 includes a pump 502, a plurality of valves 504, 506, and 508, and a controller 510 that is operatively coupled to the pump 502 and the valves 504, 506, and 508 via a bus, wires, or electrical connections 512. In operation, the pump module 500 may be used to pump borehole fluid and/or fluid stored in one or more sample chambers 513 into one or more packers to inflate the packers to hydraulically isolate a section of a borehole, pump or extract formation fluid from a formation within the hydraulically isolated portion of the borehole, deliver the extracted formation fluid to one or more of the sample chambers 513, which may be disposed in a separate sampling module, deflate the packer(s), and pump borehole fluid into the chamber 420 of the example mechanism 402 to, for example, retract the deflated packer(s) to facilitate removal of the downhole tool from the borehole.

In one example operation of the example pump module 500, the pump 502 and the valves 504, 506, and 508 may be controlled by the controller 510 to pump pressurized borehole fluid via a packer inflation/deflation flowline 514 to the cavity 426 (FIG. 4) to inflate the packer element 416 or multiples of such packer elements. In the case where the packer element(s) 416 hydraulically isolates a section of a borehole (e.g., the borehole 106) associated with a formation (e.g., the formation F) to be sampled, the controller 510 may control the pump 502 and the valves 504, 506, and 508 to draw formation fluid through a sample flowline 516. Initially, the valves 504, 506, and 508 are controlled by the controller 510 to route the fluid drawn via the sample flowline 516 to a flowline 518 that discharges the sampled fluid to the annulus of the borehole (i.e., a section of the borehole that is not within the hydraulically isolated section). When the fluid being drawn by the pump 502 via the sample flowline 516 is sufficiently contamination free (e.g., has a sufficiently low concentration of filtrate), the controller 510 may control the pump 502 and the valves 504, 506, and 508 to route sample fluid to a flowline 520, which is coupled to the one or more sample chambers 513. Following collection of a sample, the controller 510 may control the pump 502 and/or the valves 504, 506, and 508 to deflate the packer elements 416 via, for example, the packer inflation/deflation flowline 514. For example, the valves 504, 506, and 508 may be controlled to route pressurized borehole fluid in the cavity 426 to the annulus via the lines 514 and 518, thereby relieving the pressure within the cavity 426. Finally, after the packer element 416 has been deflated, the controller 510 may control the pump 502 and the valves 504, 506, and 508 to route pressurized borehole fluid to the chamber 420 via the flowline 428. Filling the chamber 420 with pressurized borehole fluid causes the sliding member, sleeve, ring, or collar 404 to apply axial force to the packer element 416 and, thus, tends to retract the packer element 416 to reduce its outer diameter.

The example mechanism 402 provides several advantages in comparison to the known retraction mechanism 302 depicted in FIG. 3. In particular, the mechanism 402 does not rely on hydrostatic borehole fluid pressure to cause the sliding member 404 to apply a sufficient axial or retraction force to the deflated packer element 416. Thus, even in shallow boreholes exhibiting a relatively low hydrostatic borehole fluid pressure, the pressurized fluid within the chamber 420 can generate a force sufficient to retract the packer element 416. Further, the sliding seals 406 and 408 of the example mechanism 402 are not subject to the substantial forces (e.g., due to high differential pressures) to which the seals 320 and 322 are subjected. As a result, the seals 406 and 408 contribute relatively little frictional force to resist the sliding of the sliding member 404, which results in longer life of the seals 406 and 408 and more of the force generated by the pressurized fluid in the chamber 420 being applied to the packer element 416.

In addition to the above described operations, the example mechanism 402 may be used in other manners and/or in connection with other downhole activities to improve the performance of an inflatable packer assembly. For example, in applications involving the use of an inflatable packer on a downhole tool coupled to a drill string, the mechanism 402 may be used to tension the inflatable packer element 416 during drilling, reaming, run-in-hole, pulled-out-of-hole, and/or any other operation that could potentially cause an inflatable packer element to expand in an undesirable manner to compromise the operation. In other words, the mechanism 402 can be used to hold an inflatable packer element 416 in place to minimize or substantially eliminate an increase in the outer diameter of the inflatable packer element 416.

Furthermore, the mechanism 402 may be locked or temporality fixed which may more firmly inflate the element 416 and/or aid in obtaining a more accurate pressure measurement within the area or section 124 of the borehole (FIG. 1). In particular, one the packer element 416 has been properly inflated, the mechanism 402 may be closed or locked by activating or closing the valve 508 to trap the fluid in the chamber 420. By locking the mechanism 402, the sliding member 404 is temporarily fixed relative to the tubular body or mandrel 410. With the sliding member 404 being fixed, the volume of the area or section 124 may be more consistent, thereby providing a more accurate pressure measurement of the fluid within area or section 124. Alternatively, the sliding member 404 may be brought into contact with the ring 422, thereby essentially eliminating the chamber 420.

During a measurement operation (e.g., measuring a formation parameter), when the pressure within the chamber 420 of the retraction mechanism 402 is fixed (e.g., by shutting off any flowlines into and/or out of the chamber 420), the pressure in the chamber 420 may be monitored via a pressure sensor 522, for example. In turn, the monitored pressure may be used to assess the potential equality of the measurement made. For example, a determination that little, if any, pressure change within the chamber 420 occurred during a measurement operation may be indicative that the quality of the measurement is likely high, whereas a large enough pressure change may be indicative that the quality of the measurement is poor or latent with noise. A similar determination may be made when the sliding member 404 is brought into contact with the ring 422. For example, a sensor (not shown) located at or near the chamber 420 that is able to determine relative movement or loss of contact between the sliding member 404 and the ring 422. In particular, if separation between the sliding member 404 and the ring 422 is detected, it may be indicative of a poor pressure measurement or noise.

A more refined analysis may be made by tracking or measuring the position of the sliding member 404 (e.g., via the position sensor 430) relative to the ring 422 or the tubular body or mandrel 410. The sensor 430 may be a potentiometer, Hal effect sensor or the like, and may be located within the chamber 420 to avoid the harsh environment created from contact with formation or drilling fluid. In obtaining a measurement of the movement of the sliding member 404 a quantifiable error or resultant pressure change due to the movement of the sliding member 404 may be obtained. This movement may then be used to adjust, correct or explain a pressure measurement or anomaly, whereas a lack of movement may be indicative of a high quality measurement.

Although certain methods, apparatus, and articles of manufacture have been described herein, the scope of coverage of this patent is not limited thereto. To the contrary, this patent covers all methods, apparatus, and articles of manufacture fairly falling within the scope of the appended claims either literally or under the doctrine of equivalents.

What is claimed is:

1. An apparatus to apply axial retraction force to retract an inflatable packer associated with a downhole tool, comprising:

a sleeve slidingly coupled to a body of the downhole tool and an end of the packer, wherein an inner portion of the sleeve is sealed against the body of the downhole tool to form a chamber, and wherein the chamber is fluidly coupled to a pump associated with the downhole tool to receive a pressurized fluid to cause the sleeve to apply an axial retraction force to the packer to retract the packer.

2. An apparatus as defined in claim 1, wherein the chamber is further configured to receive the pressurized fluid to apply the axial force to tension the packer while deflated.

3. An apparatus as defined in claim 1, wherein the pump associated with the downhole tool is to reduce a volume in the chamber.

4. An apparatus as defined in claim 1, wherein the pressurized fluid is one of borehole fluid and fluid stored in a sample chamber.

5. An apparatus as defined in claim 1, wherein the pressurized fluid is at a pressure that exceeds at least one of a hydrostatic pressure and an interval pressure.

6. An apparatus as defined in claim 1, wherein the chamber is formed at least partially by a portion of the sleeve that extends toward the body of the downhole tool.

7. An apparatus as defined in claim 6, wherein the portion of the sleeve comprises a lip.

8. An apparatus as defined in claim 1, wherein the chamber is formed at least partially by a ring coupled to the body of the downhole tool and extending away from the body of the downhole tool.

9. An apparatus as defined in claim 1, further comprising one of o-rings and t-seals to seal the sleeve against the body of the downhole tool.

10. An apparatus as defined in claim 1, wherein the body of the downhole tool comprises a mandrel.

11. An apparatus as defined in claim 1, wherein the sleeve is coupled to the end of the packer via threads.

12. An apparatus as defined in claim 1, wherein the sleeve has a substantially L-shaped cross-section.

13. A downhole tool, comprising:

a pump module;

an inflatable packer fluidly coupled to the pump module;

a sliding member coupled to the inflatable packer;

a chamber formed between the sliding member and a body of the downhole tool; and a fluid passage to fluidly couple the chamber to the pump module to cause the sliding member to apply an axial retraction force to the inflatable packer to retract the inflatable packer.

14. A downhole tool as defined in claim 13, wherein the axial force is further configured to tension the packer while the packer is deflated.

15. A downhole tool as defined in claim 13, wherein the sliding member comprises a seal to seal the chamber.

16. A downhole tool as defined in claim 13, wherein the pump module is fluidly coupled to at least one of an inlet and a sample chamber.

17. A downhole tool as defined in claim 13, wherein the chamber is to be pressurized by the pump module at a pressure greater than a pressure surrounding at least a portion of the downhole tool to cause the sliding member to apply the axial force to the packer.

18. An apparatus, comprising:

a pump module;

a packer fluidly coupled to the pump module;

a sliding member coupled to the packer;

a chamber formed between the sliding member and a body of the apparatus;

a fluid passage configured to fluidly couple the chamber to the pump module to cause the sliding member to apply an axial retraction force to the packer to retract the packer; and at least one of an o-ring and a t-seal configured to seal the sliding member against the body of the apparatus; wherein:

the axial retraction force is further configured to tension the packer while the packer is deflated;

the pump module is fluidly coupled to one of an inlet and a sample chamber and is configured to pump pressurized fluid comprising one of borehole fluid and fluid stored in the sample chamber;

the chamber is configured to be pressurized by the pump module at a pressure greater than a pressure surrounding at least a portion of the apparatus to cause the sliding member to apply the axial retraction force to the packer;

the sliding member is coupled to the packer via threads;

the sliding member has a substantially L-shaped cross-section;

the chamber is formed at least partially by a portion of the sliding member that extends toward the body of the apparatus;

the portion of the sliding member comprises a lip; and the chamber is formed at least partially by a ring coupled to the body of the apparatus and extending away from the body of the apparatus.

* * * * *